US006149569A

United States Patent [19]

Eberle

[11] Patent Number: 6,149,569

[45] Date of Patent: Nov. 21, 2000

[54] CENTRIFUGE APPARATUS WITH MEASURING DEVICE ON A TRANSPARENT COVER

[75] Inventor: Guenter Eberle, Tuttlingen, Germany

[73] Assignee: Firma Andreas Hettich, Germany

[21] Appl. No.: 09/058,482

[22] Filed: Apr. 10, 1998

[30] Foreign Application Priority Data

Apr. 12, 1997 [DE] Germany ..... 197 15 344

[51] Int. Cl.[7] ..... B04B 7/02

[52] U.S. Cl. ..... 494/10; 494/67; 494/68; 494/70; 494/72

[58] Field of Search ..... 494/10, 72

[56] References Cited

U.S. PATENT DOCUMENTS

| | | | |
|---|---|---|---|
| D. 259,140 | 5/1981 | Pross et al. | D24/219 |
| 2,831,252 | 4/1958 | Weichselbaum . | |
| 2,885,145 | 5/1959 | Danielsson et al. | 494/10 |
| 3,168,473 | 2/1965 | Goda et al. . | |
| 4,052,164 | 10/1977 | König . | |
| 4,128,400 | 12/1978 | Muhlbock et al. | 422/101 |
| 5,316,952 | 5/1994 | Brimhall . | |

FOREIGN PATENT DOCUMENTS

| | | |
|---|---|---|
| 1 070 407 | 12/1959 | Germany . |
| 6751126 | 2/1969 | Germany . |
| 28 38 783 | 3/1980 | Germany . |

*Primary Examiner*—Joseph W. Drodge
*Assistant Examiner*—Michael A. Fleming
*Attorney, Agent, or Firm*—Brown, Martin, Haller & McClain, LLP

[57] ABSTRACT

The present invention is a centrifuge essentially comprised of a rotor and a transparent cover which can be fixed to the rotor. The cover is provided with a plurality of spaced concentration lines each extending around the cover and a plurality of different graduated scales extending radially from the center of the cover across the concentration lines at spaced angular intervals. The rotor and the cover also have opposing snap lock elements at a central portion of the rotor and the cover.

1 Claim, 2 Drawing Sheets

1
2
3
4
5
8

CENTRIFUGE APPARATUS WITH MEASURING DEVICE ON A TRANSPARENT COVER

BACKGROUND OF THE INVENTION

This invention relates to a centrifuge device.

The principle of centrifugation has been long known. Particles of differing density contained in liquids can be separated by centrifugal force.

A number of possible structures for centrifuge devices are known in the art. A first structure, is used, e.g., to separate and collect components of blood as the centrifugation proceeds. This known structure is generally practicable only where a substantial amount of the liquid matrix which is to be centrifuged to accomplish the separation is present; the container for said liquid must be provided with one or more connections to supply and withdraw liquid.

A hematocrit centrifuge apparatus employs small capillary tubes. The present invention is particularly applicable to such a centrifuge and such a process. According to the state of the art, following the centrifugation the tube must be removed from the rotor and inserted in a reading device, or else the cover of the rotor must be removed and a separate reading device must be applied. This entails excessive and costly handling.

SUMMARY OF THE INVENTION

The underlying problem of the present invention was to improve a centrifuge of the above-described type so as to appreciably facilitate the handling involved.

According to the present invention, a centrifuge is provided which comprises a rotor, and a transparent cover removably secured to the rotor, the cover having a measuring device comprising a graduated scale for reading values established after a centrifuging procedure. In this way, monitoring and measurement are facilitated. The scales may be uniform, wherewith the concentration lines may comprise circles; or scales having different measurement layouts may be provided, wherewith the units and interrelations of the measurements afforded by the different scales may differ, and moreover the concentration lines may be generally spirally configured.

When the second alternative as just stated is adopted, a given cover may be employed for a large variety of liquids to be centrifuged.

This presents opportunities for optical monitoring and readout—which is adequate for the majority of applications. In particular, it is noted that the components of the liquid which have different densities, in respect of the centrifugation process, also have different colors; therefore the results provided by optical monitoring and readout, possibly with optically mediated control, can be very acceptable. This is particularly the case for hematocrit or other blood centrifugation applications.

The invention allows the hematocrit to be read directly and easily, as soon as the centrifugation is completed. No separate readout devices are needed.

In addition to or alternatively to the described scales and concentration lines, a pattern (or overlay or the like) may be employed which is specific to the given liquid to be centrifuged. This pattern may be fixed to the cover and/or rotor.

BRIEF DESCRIPTION OF THE DRAWINGS

The present invention will be better understood from the following detailed description of a preferred embodiment of the invention, taken in conjunction with the accompanying drawings in which like reference numerals refer to parts and in which like reference numerals refer to like parts and in which.

DESCRIPTION OF THE PREFERRED EMBODIMENT

Figures 1, 2:
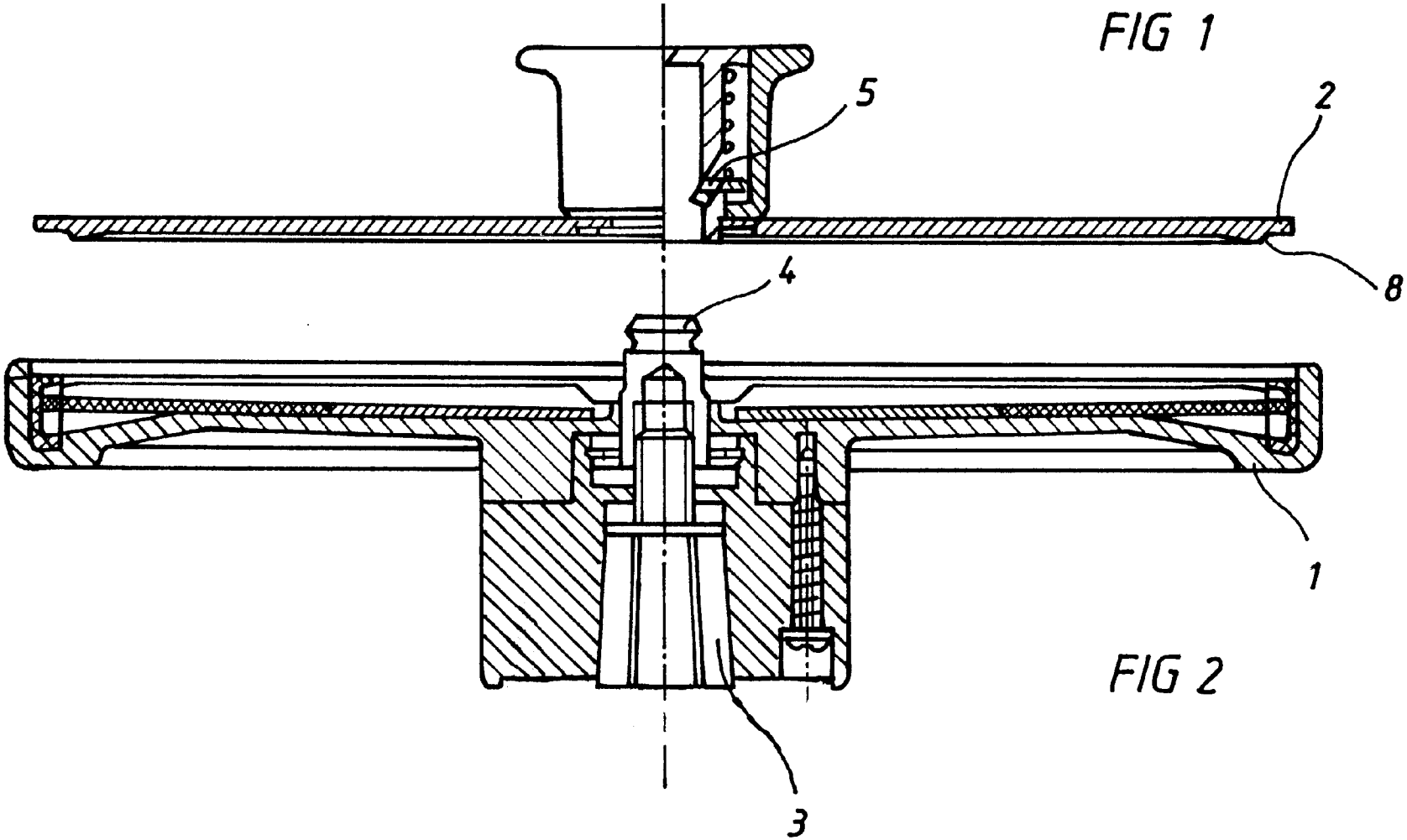
FIG. 1 is a cross-sectional view of the cover of an inventive centrifuge.
FIG. 2 is a cross-section through the rotor of an inventive centrifuge.

The centrifuge illustrated in FIGS. 1 and 2 is comprised essentially of a rotor 1 onto which a cover 2 can be applied. The cover is transparent. The lower end of rotor 1 bears a connection 3 for drive means, and the upper end of rotor 1 bears a connection 4 for the cover 2.

The cover 2 may be provided with a catch element 5 which engages a corresponding groove in the connection 4, to secure the cover 2 to the rotor.

Figure 3:
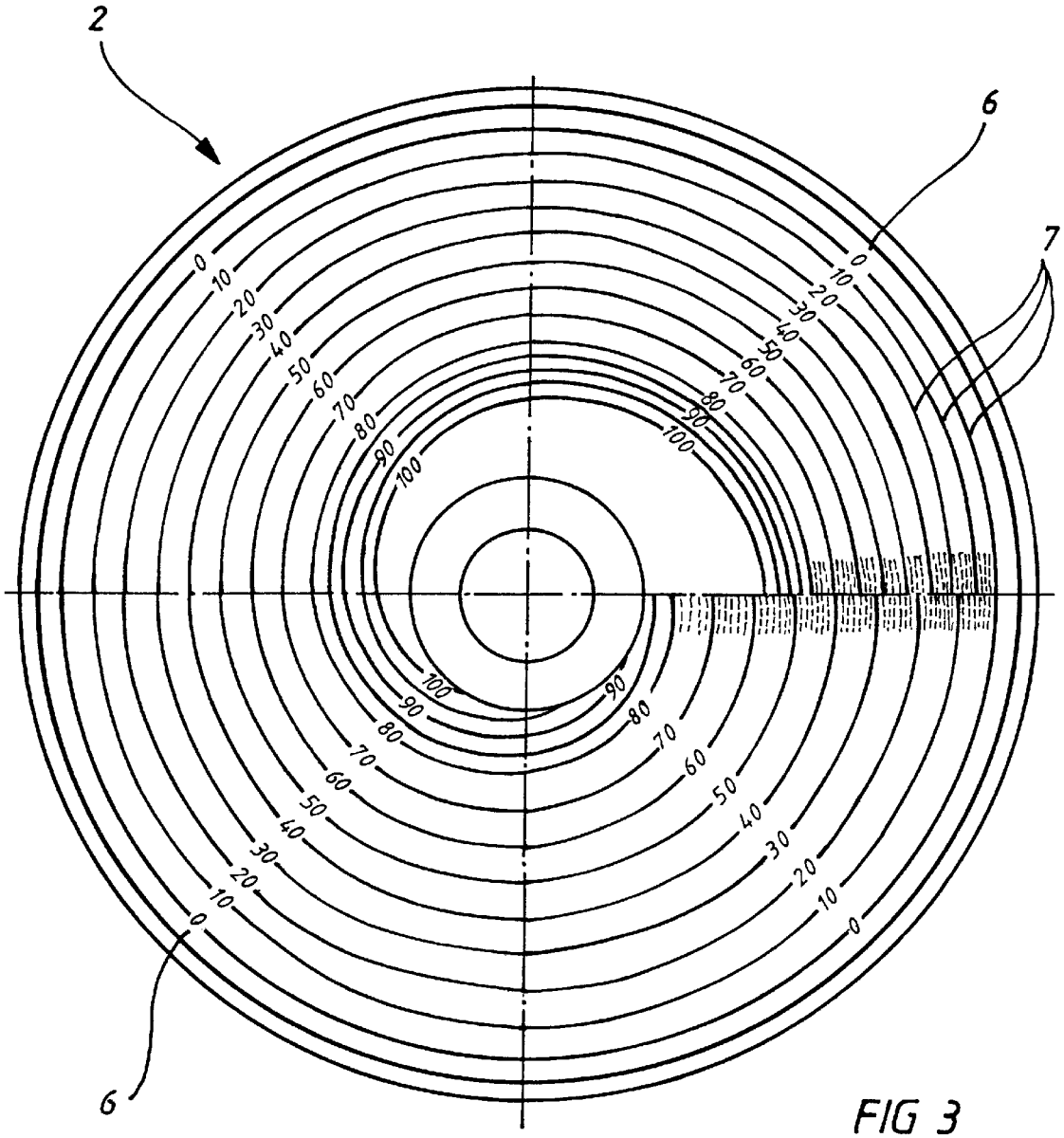
FIG. 3 is a plan view of the cover of the inventive centrifuge according to FIG. 1.

FIG. 3 illustrates a plurality of scales 6 and concentration lines 7 provided on the cover 2. In the embodiment shown, the scales 6 and concentration lines 7 extend around the cover in a generally spiral or screw-shaped configuration. This has the advantage of admitting a plurality of different scales and associated concentration lines on a given cover. Thereby a single cover can be used with a variety of liquids to be centrifuged, without the need to modify the cover or to convert the readings.

Further, the underside of cover 2 may be provided with a projection 8 extending around its circumferential region, which projection comes to abut against a corresponding counter-surface of the rotor 1. The (hematocrit) tubes which are to undergo centrifugation can then be accommodated in normal fashion, in the cavity which is formed between the rotor 1 and the cover 2.

The inventive centrifuge offers enhanced versatility and ease of use, whereby capillary tubes containing materials which are to undergo centrifugation can be handled and monitored easily and quickly.

All information and features disclosed in the application, including the disclosures in the Abstract, and particularly the spatial configurations illustrated in the drawings, are claimed as essential to the invention, to the extent they are novel in the light of the state of the art.

Although a preferred embodiment of the invention has been described above by way of example only, it will be understood by those skilled in the field that modifications may be made to the disclosed embodiment without departing from the scope of the invention, which is defined by the appended claims. The claimed matter of the invention lies in the individual claims and in the combination of same.

I claim:

1. A centrifuge apparatus, comprising:

a rotor;

cover releasably secured to the rotor for rotation with the rotor;

a securing device releasably securing the cover to the rotor to form a centrifuge cavity between the cover and rotor for receiving capillary tubes containing material to be centrifuged;

the cover being transparent;

a measuring device on the cover, whereby the contents of the capillary tubes may be measured and monitored;

the measuring device comprising a plurality of spaced concentration lines each extending around the cover in a generally spiral configuration whereby the spacing between each adjacent pair of concentration lines varies around the cover, and a plurality of different graduated scales extending radially from the center of the cover across the concentration lines at spaced angular intervals, each scale comprising a series of numerical markings associated with respective concentration lines and the scales defining a plurality of different measurement layouts; and the rotor and the cover each having a central portion and the securing device comprising opposing snap lock elements at the central portion of the rotor and cover, one of the snap lock elements comprising a central projection having an annular groove and the other snap lock element comprising an opening for fitting over the projection, the opening having an annular rib for releasable snap lock engagement in the groove.

* * * * *

UNITED STATES PATENT AND TRADEMARK OFFICE

CERTIFICATE OF CORRECTION

PATENT NO. : 6,149,569
DATED : November 21, 2000
INVENTOR(S) : Guenter Eberle

It is certified that error appears in the above-identified patent and that said Letters Patent is hereby corrected as shown below:

Column 2,
Line 58, insert -- a -- before "cover"

Signed and Sealed this

Sixth Day of November, 2001

*Attest:*

Nicholas P. Godici

NICHOLAS P. GODICI
*Acting Director of the United States Patent and Trademark Office*

*Attesting Officer*